United States Patent [19]

Field et al.

[11] Patent Number: 5,053,829

[45] Date of Patent: Oct. 1, 1991

[54] HEAT AND PRESSURE FUSER WITH NON-SYMMETRICAL NIP PRESSURE

[75] Inventors: John R. Field, Red Creek; Robert S. Karz, Webster; Rabin Moser, Fairport; James E. Mathers, Rochester, all of N.Y.

[73] Assignee: Xerox Corporation, Stamford, Conn.

[21] Appl. No.: 252,336

[22] Filed: Oct. 3, 1988

[51] Int. Cl.[5] ..... G03G 15/20

[52] U.S. Cl. ..... 355/290; 355/285; 355/295; 219/216

[58] Field of Search ..... 355/282, 285, 289, 290, 355/295, 284; 430/124; 219/216

[56] References Cited

U.S. PATENT DOCUMENTS

| | | | |
|---|---|---|---|
| 3,976,814 | 8/1976 | Murphy | 430/124 X |
| 4,397,936 | 8/1983 | Sakata et al. | 430/124 |
| 4,512,650 | 4/1985 | Kocher | 219/216 X |
| 4,533,231 | 8/1985 | Shigenobu | 355/284 |
| 4,563,073 | 1/1986 | Reynolds | 355/290 X |
| 4,565,439 | 1/1986 | Reynolds | 355/290 |
| 4,582,416 | 4/1986 | Karz et al. | 355/290 |
| 4,627,813 | 12/1986 | Sasaki | 355/290 X |
| 4,812,873 | 3/1989 | Inagaki et al. | 355/290 |
| 4,927,727 | 5/1990 | Rimai et al. | 430/124 X |
| 4,931,618 | 6/1990 | Nagata et al. | 219/216 |
| 4,961,704 | 10/1990 | Nemoto et al. | 219/216 X |

FOREIGN PATENT DOCUMENTS

| | | | |
|---|---|---|---|
| 0151681 | 8/1985 | Japan | 355/290 |
| 0063077 | 3/1988 | Japan | 355/295 |

*Primary Examiner*—A. T. Grimley
*Assistant Examiner*—Matthew S. Smith

[57] ABSTRACT

A heat and pressure fusing apparatus for fixing toner images to substrates such as plain paper, the toner comprising a thermoplastic resin. The apparatus includes two nip forming members which cooperate to form a nip having an asymmetrical pressure profile. Thus, the pressure profile through the nip, from entrance to exit, is such that toner images on a substrate passing through the nip are first subjected to relatively low pressure which continues until the toner begins to flow. Once toner flow commences, the images are subjected to pressure high enough to force the toner into the substrate. The nip is readily variable for accommodating different fusing speeds for different processors.

4 Claims, 3 Drawing Sheets

HEAT AND PRESSURE FUSER WITH NON-SYMMETRICAL NIP PRESSURE

BACKGROUND OF THE INVENTION

This invention relates generally to copying or printing apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. With this conventional type of arrangement, the temperature profile through the nip is somewhat exponential while the pressure profile is symmetrical. A plot of nip pressure versus position in the nip yields a somewhat parabolic shape. A symmetrical pressure profile results in the application of high pressure to toner which is not yet in a molten state. This results in wasted mechanical energy.

As fuser speeds increase, it becomes more and more difficult to obtain adequate nips using roll fusers because the nip width varies approximately as the square of the roll diameter. Thus, for example, doubling the process speed would require double the nip width which, in turn, would increase the fuser and pressure roll diameters by a factor of four. In addition, larger rolls require higher loads and produce an inferior release geometry. The foregoing drawbacks do not apply to belt fusers. Thus, belt fusers of the prior art have been provided with larger nip areas in order to allow faster fusing speeds. However, all known prior devices inherently waste mechanical energy due to their symmetrical pressure profiles.

Belt fusers are known in the prior art. For example, U.S. Pat. Nos. 4,563,073 and 4,565,439 each disclose a heat and pressure fusing apparatus for fixing toner images. The fusing apparatus is characterized by the separation of the heat and pressure functions such that the heat and pressure are effected at different locations on a thin flexible belt forming the toner contacting surface. A pressure roll cooperates with a stationary mandrel to form a nip through which the belt and copy substrate pass simultaneously. The belt is heated such that by the time it passes through the nip its temperature together with the applied pressure is sufficient for fusing the toner images passing therethrough. A release agent management (RAM) system comprising low mass donor and metering rolls, one of which is in contact with the belt, applies silicone oil to the belt without unacceptably reducing the fusing capability of the belt.

BRIEF SUMMARY OF THE INVENTION

According to the present invention, the fusing nip is configured such that the pressure profile through the nip form its entrance to its exit is asymmetrical. Thus, the toner image initially moves therethrough at a low pressure (only large enough to insure good thermal contact and minimum image shifting) while being heated to a molten state. Then the molten image is subjected to a very high pressure pulse which forces the molten toner into the substrate. The invention provides for several unique advantages, one being that mechanical energy is not wasted in trying to force unmolten toner into the substrate. Another advantage is that the peak pressure is provided at a more optimum time, e.g. closer to the nip exit. Another advantage is that the length of the low pressure zone can be easily adjusted to provide adequate dwell at almost any process speed, thus enabling a very high speed fuser.

In one embodiment of the invention, a belt fuser module is loaded against a conformable (i.e. elastomer coated) pressure roll. The front portion of the belt module roll is loaded past top dead center of the pressure roll with the belt properly tensioned. This provides a low pressure nip entry zone and a high pressure final fixing zone.

In another embodiment of the invention, a belt is employed which operates between a mandrel and a pressure roll to form a nip between the belt and the pressure roll. The mandrel is shaped to produce a low pressure zone at the nip entrance leading to a high pressure zone and small radius of curvature at the nip exit zone, the small radius of curvature resulting in good stripping.

DETAILED DESCRIPTION OF THE PREFERRED EMBODIMENTS OF THE INVENTION

Figure 1:
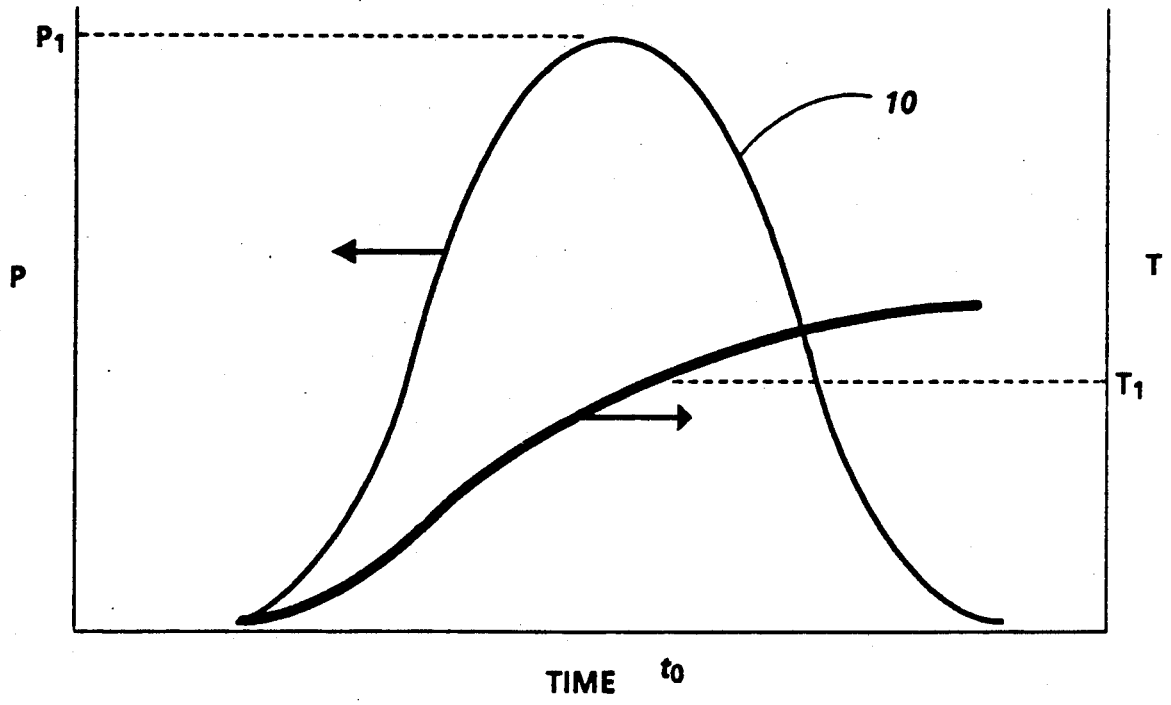
FIG. 1 is a plot of temperature and pressure versus time for a typical prior art fuser.

FIG. 1 illustrates temperature and pressure profiles through a conventional roll fuser nip from its entrance to its exit. A plot of pressure versus time (or distance through the nip) represented by reference character 10 shows that the pressure profile through the nip is symmetrical and has a somewhat parabolic shape. It also shows that the maximum pressure $P_1$ in the nip coincides with a temperature $T_1$. At the temperature $T_1$ which occurs at the maximum pressure the toner forming the images on a substrate has not been sufficiently heated to cause the toner to flow or become molten. Accordingly, the mechanical energy employed at that time to force unmolten toner into the paper is wasted.

Figure 2:
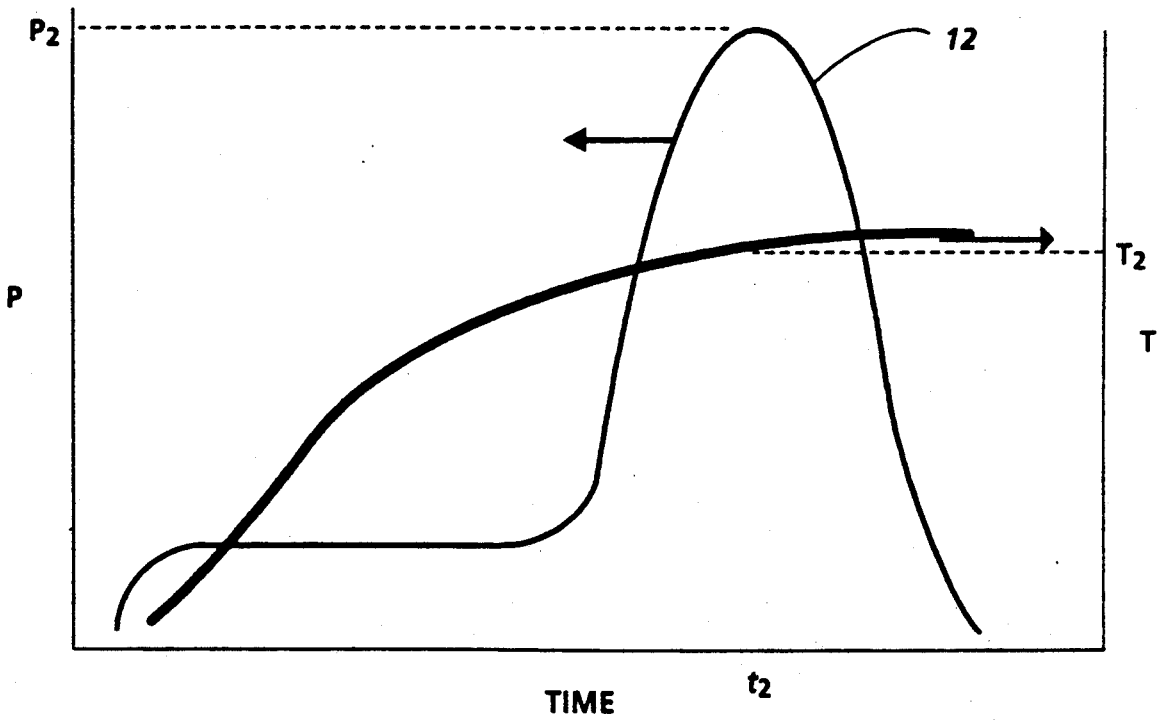
FIG. 2 is a plot of temperature and pressure versus time for the fuser of the present invention.

FIG. 2 illustrates temperature and pressure profiles through a fuser nip created in accordance with the present invention which will be discussed in greater detail hereinafter. A plot of pressure versus time represented by reference character 12 shows that the pressure profile through the nip of our invention is asymmetrical. It further shows that the peak pressure $P_2$ coincides with peak temperature $T_2$, the temperature at which the toner has become molten and commences to flow.

Figure 3:
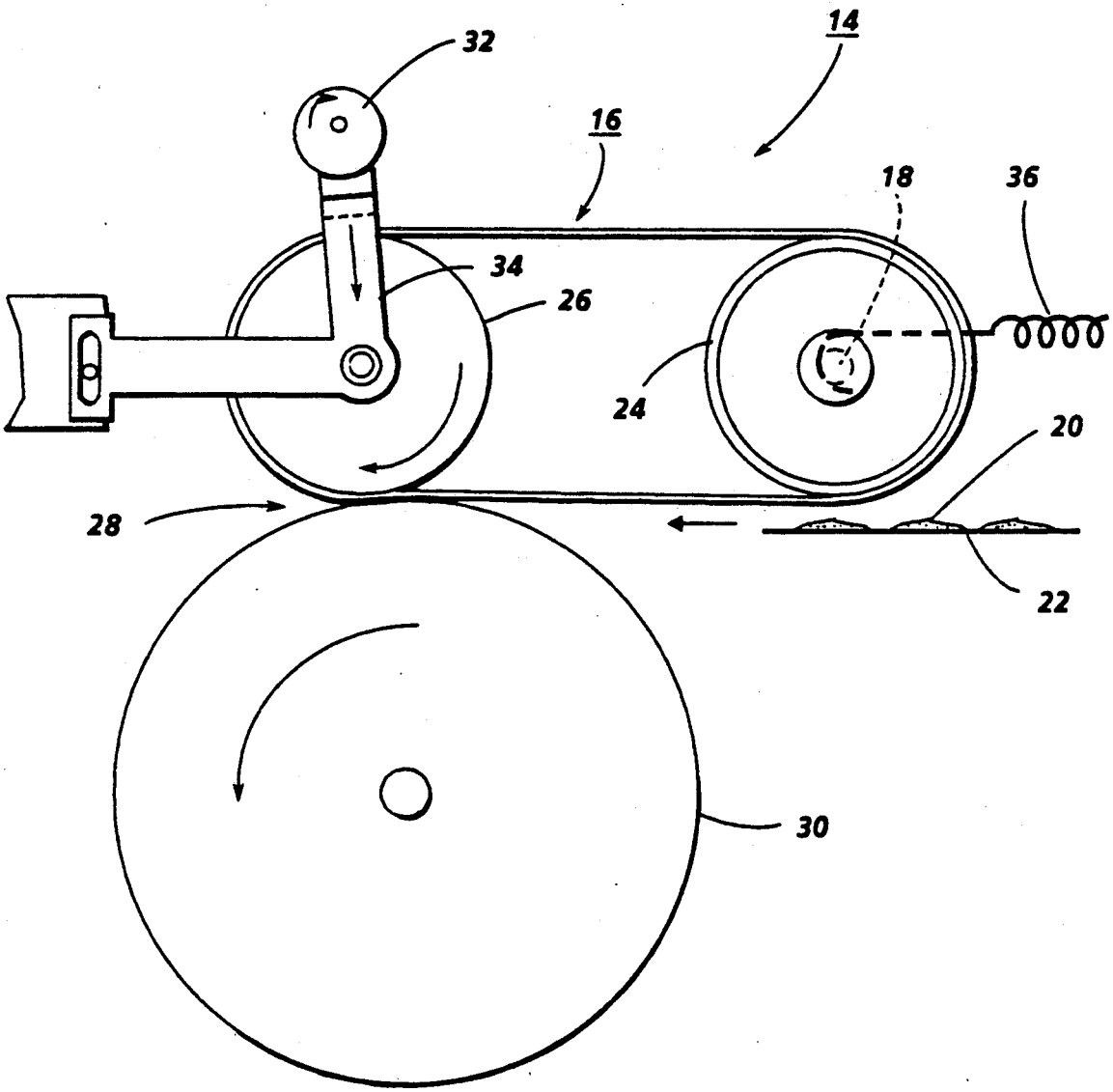
FIG. 3 is a side elevational schematic view of a heat and pressure fuser incorporating the present invention.

FIG. 3 depicts an embodiment of a heat and pressure fuser apparatus 14 in which the temperature and pressure profiles illustrated in FIG. 2 are present in the nip thereof.

The fuser apparatus 14 disclosed in FIG. 3 comprises a relatively thin fuser belt structure 16 comprising a base member preferably fabricated from a metal material such as nickel by a conventional electroforming process which provides a uniform thickness in the order of 2–3 mils. The outer surface of the base member is coated with a conformable layer which preferably comprises silicone rubber. The inner surface of the base member is preferably coated with a low friction material such as polytetrafluoroethylene, commonly known by the tradename Teflon (registered trademark of E. I. duPont). The thickness of the conformable layer is preferably at least 5 mils.

The belt structure is heated by a radiant lamp or heater 18 to a temperature suitable for fusing toner images 20 carried by copy substrates 22. The radiant heater is positioned internally of a roller structure 24 which cooperates with a roller structure 26 to support the belt structure 16 for movement through a nip 28. The nip 28 is formed between the roller 26, belt structure 16 and a backup or pressure roller 30. The roller structure 24 is fabricated so that it is transparent to the radiant energy from the lamp 18.

A suitable force applying device such as a cam 32 and cam follower arm 34 is provided for effecting pressure engagement between the roller 26 and pressure roller 30. The line of force applied through the roller 26 is such as to create an asymmetrical pressure profile in the nip 28 which provide for the coincidence of a peak nip pressure and a temperature at which the toner particles forming the toner images is somewhat molten. A suitable drive, not shown serves to drive one of the rollers 24 and 26 which, in turn, frictionally effects movement of the belt about thereabout. A mechanical biasing member 36 in the form of a spring provides proper tensioning of the belt 16.

Figure 4:
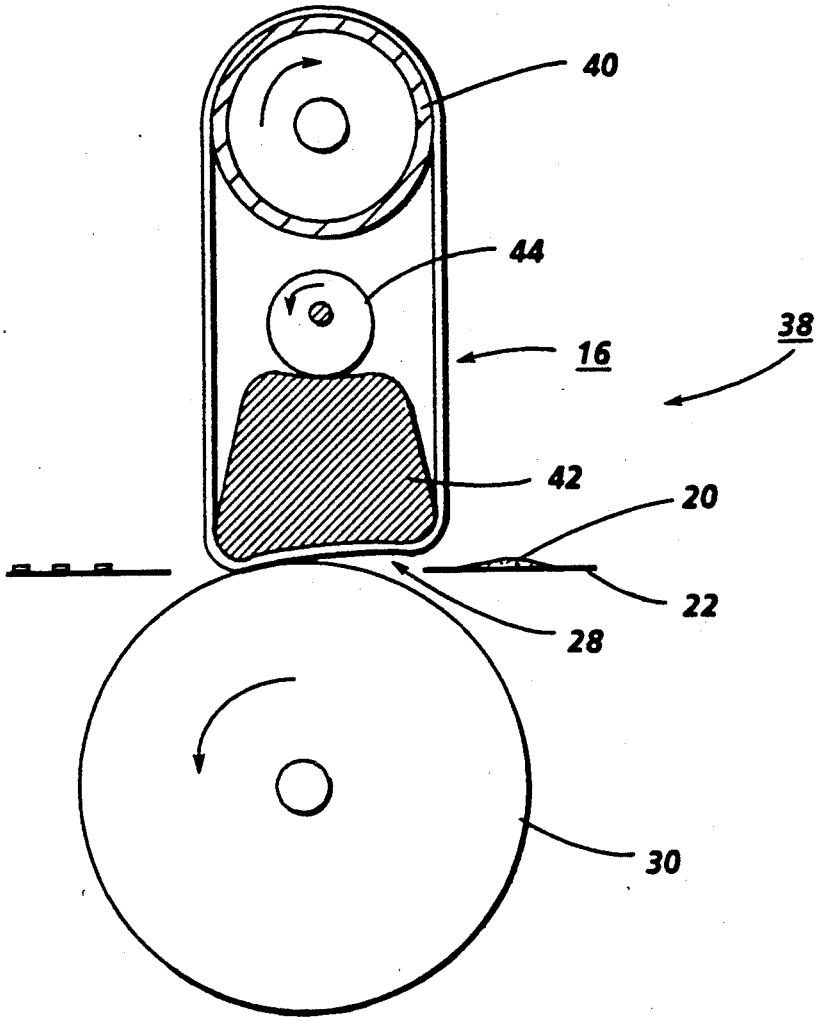
FIG. 4 is a side elevational view, partly in cross-section of another embodiment of the present invention; and FIG. **4*a* is a plot of the load or pressure in the nip of the fuser of FIG. 4** versus position in the nip.

Another embodiment of the invention as shown in FIG. 4 comprises a fuser apparatus including a belt structure 16. The belt is heated by means of an internally heated roller 40. In lieu of the roller 26 of the embodiment illustrated in FIG. 3*a* stationary mandrel 42 is utilized for cooperating with the roller 40 for operatively supporting the belt structure 16.

Figure 4A:
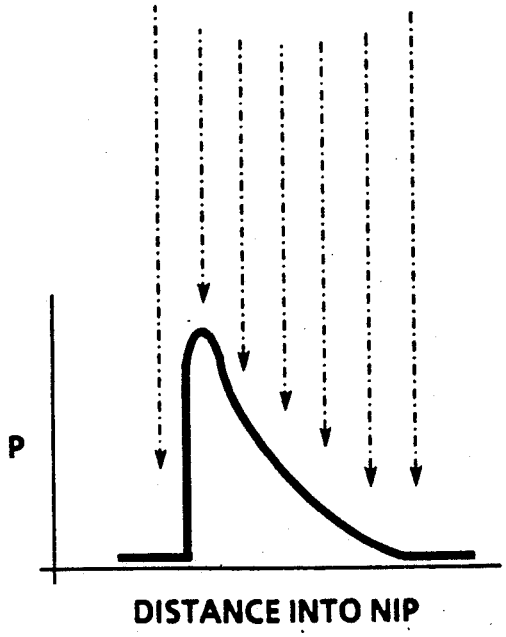

The belt 16 and mandrel 42 cooperate with a pressure roller 30 to form a nip 28 through which substrates carrying toner images pass with the images contacting the heated belt structure. The force necessary to effect nip pressure between the mandrel, belt and pressure roll is provided by means of a rotary cam 44. The mandrel 42 is configured such that when the load is applied via the cam 44 the pressure profile created in the nip is as depicted in FIG. 4*a*. As illustrated in FIG. 4*a*, the pressure through the nip is asymmetrical so that the peak pressure in the nip does not occur before the temperature of the toner images is sufficiently high to cause the toner to be somewhat molten and able to flow into the substrate when the pressure is applied.

What is claimed is:

1. Heat and pressure fuser apparatus, said apparatus comprising:

a first nip forming member;

a second nip forming member;

means for applying a load between said members to thereby form a nip therebetween, said nip having a substrate entrance zone and exit zone;

one of said nip forming members comprising means engaging the other of said nip forming members with different degrees of pressure when said load is applied whereby said nip has an asymmetrical pressure profile, said asymmetrical nip being arranged so that the pressure in said entrance zone is lower than the pressure in said exit zone.

2. Apparatus according to claim 1, wherein said engaging means comprises a belt and a stationary mandrel, said mandrel having an end thereof adjacent said exit zone closer to said second nip forming member than an end thereof adjacent said entrance zone whereby the pressure in said entrance zone is less than the pressure in said exit zone.

3. Method of heat and pressure fusing toner images, said method comprising the steps of:

providing a first nip forming member;

providing a second nip forming member;

applying a load between said members to thereby form an asymmetrical nip therebetween with a substrate entrance zone and an exit zone wherein the pressure in the exit zone is greater that the pressure in the entrance zone; and moving a copy substrate having toner images thereon through said entrance zone before said exit zone.

4. The method according to claim 3 wherein said step of applying a load is accomplished using a belt and a stationary mandrel wherein said mandrel has an end thereof adjacent said exit zone closer to said second nip forming member than the end thereof adjacent said entrance zone.

* * * * *